US008938968B2

(12) United States Patent
Buss et al.

(10) Patent No.: US 8,938,968 B2
(45) Date of Patent: Jan. 27, 2015

(54) BURNER OF A GAS TURBINE

(75) Inventors: Johannes Buss, Nussbaumen (CH); Andrea Ciani, Zurich (CH); Michael Düsing, Rheinfelden (DE); Adnan Eroglu, Untersiggenthal (CH)

(73) Assignee: Alstom Technology Ltd., Baden (CH)

( * ) Notice: Subject to any disclaimer, the term of this patent is extended or adjusted under 35 U.S.C. 154(b) by 1036 days.

(21) Appl. No.: 12/642,086

(22) Filed: Dec. 18, 2009

(65) Prior Publication Data

US 2010/0236246 A1 Sep. 23, 2010

(30) Foreign Application Priority Data

Dec. 19, 2008 (EP) ..... 08172239

(51) Int. Cl.

| | |
|---|---|
| ***F02C 1/00*** | (2006.01) |
| ***F02C 7/08*** | (2006.01) |
| ***F23D 14/64*** | (2006.01) |
| ***F23D 11/40*** | (2006.01) |
| ***F23D 17/00*** | (2006.01) |
| ***F23R 3/12*** | (2006.01) |
| ***F23R 3/28*** | (2006.01) |

(52) U.S. Cl.

CPC ..... *F23D 14/64* (2013.01); *F23D 11/402* (2013.01); *F23D 17/002* (2013.01); *F23R 3/12* (2013.01); *F23R 3/286* (2013.01); *F23C 2900/07021* (2013.01); *F23D 2900/14021* (2013.01)

USPC ..... 60/737; 60/733; 60/734; 60/740; 60/742

(58) Field of Classification Search

USPC ..... 60/39.17, 733, 734, 737, 738, 740, 742; 239/398, 416.5, 418, 422, 423, 424, 239/424.5, 425, 434, 533.2

See application file for complete search history.

(56) References Cited

U.S. PATENT DOCUMENTS

| | | | | |
|---|---|---|---|---|
| 4,455,840 | A * | 6/1984 | Matt et al. | 60/737 |
| 5,293,843 | A * | 3/1994 | Provol et al. | 122/4 D |
| 5,487,659 | A * | 1/1996 | Eroglu et al. | 431/350 |
| 5,513,982 | A | 5/1996 | Althaus et al. | |
| 5,609,030 | A * | 3/1997 | Althaus | 60/737 |

(Continued)

FOREIGN PATENT DOCUMENTS

| | | | |
|---|---|---|---|
| DE | 10 2004 041 272 | A1 | 3/2006 |
| EP | 0 623 786 | A1 | 11/1994 |

(Continued)

OTHER PUBLICATIONS

European Search Report dated Jul. 2, 2009.

*Primary Examiner* — William H Rodriguez
*Assistant Examiner* — Arun Goyal
(74) *Attorney, Agent, or Firm* — Buchanan Ingersoll & Rooney PC

(57) ABSTRACT

An exemplary burner of a gas turbine includes a tubular body with an inlet for an entrance of an air flow, downstream of inlet vortex generators, and a lance projecting into the tubular body and having a terminal portion extending along a longitudinal axis of the burner which is provided with nozzle groups for injecting fuel into the tubular body. The nozzle groups can lay in an injection plane perpendicular to the axis of the terminal portion of the lance. Downstream of the lance, the burner has an outlet. A ratio x/L between an axial distance x between the side trailing edge of the vortex generator and the injection plane, and the length L of the tubular body can be less than approximately 0.1052.

24 Claims, 3 Drawing Sheets

(56) References Cited

U.S. PATENT DOCUMENTS

| | | | | |
|---|---|---|---|---|
| 5,829,967 | A | 11/1998 | Chyou | |
| 6,095,791 | A * | 8/2000 | Senior | 431/8 |
| 6,325,618 | B1 | 12/2001 | Benz et al. | |
| 2007/0207425 | A1 | 9/2007 | Brautsch et al. | |

FOREIGN PATENT DOCUMENTS

| | | | |
|---|---|---|---|
| EP | 0 733 861 | A2 | 9/1996 |
| EP | 1 030 109 | A1 | 8/2000 |
| WO | WO 2009/019113 | A2 | 2/2009 |
| WO | WO 2009/019114 | A2 | 2/2009 |

* cited by examiner

BURNER OF A GAS TURBINE

RELATED APPLICATION

This application claims priority under 35 U.S.C. §119 to European Patent Application No. 08172239.9 filed in Europe on Dec. 19, 2008, the entire content of which is hereby incorporated by reference in its entirety.

FIELD

The present disclosure relates to a burner of a gas turbine.

BACKGROUND INFORMATION

Sequential combustion gas turbines are known which include a compressor for compressing a main air flow. Such turbines can include a first burner for mixing a first fuel with the main air flow and generating a first mixture to be combusted, a high pressure turbine where the gases coming from the first burner are expanded, a second burner where a second fuel is injected in the already expanded gases to generate a second mixture to be combusted, and a low pressure turbine where also the gases coming from the second burner are expanded.

The second burner of the sequential combustion gas turbine can include a tubular body with a trapezoidal cross section.

The body can house, downstream of an inlet for the gas flow, four tetrahedral in shape vortex generators, arranged to generate four pairs of counter rotating vortices.

The vortex generators can be located at the upper, bottom and side walls of the body and, specifically, the upper and bottom vortex generators can be closer to the inlet of the body than the side vortex generators.

In addition, the upper and bottom vortex generators can have trailing edges which lay in a first plane perpendicular to the longitudinal axis of the burner, and the side vortex generators have trailing edges which lay in a second plane perpendicular to the longitudinal axis of the burner, the first plane being closer to the inlet than the second plane.

The burner can also include a lance to inject a fuel into the main compressed air flow, such that the fuel mixes with the compressed air and generates a mixture to be burnt.

The lance can be made of a number of coaxial tubular elements for injecting a liquid fuel, a gaseous fuel and air. Each of these tubular elements can be provided at the end of the lance with nozzles, which are coaxial with each other and define a plurality of nozzle groups for injecting fuel and air into the burner.

These nozzle groups can be all placed in a plane (the injection plane) and inject fuel along this injection plane.

The injection plane can be very far away from the second plane containing the trailing edges of the side vortex generators.

In addition, the nozzles groups can also be symmetrically placed both with respect to a transversal plane of the terminal portion of the lance and a longitudinal plane perpendicular to the transversal plane.

These features can allow an easy and inexpensive manufacturing of the burner and the lance, but can result in an incorrect mixing of the fuel with the hot gas flow coming from the high pressure turbine.

The quality of mixing can greatly influence the NOx emissions (according to an exponential correlation between NOx and unmixedness). It is therefore desirable to optimize the burner and, in particular, the lance which injects the fuel, in order to optimize mixing of the fuel with the main flow of compressed air and thus lower NOx emissions.

SUMMARY

A burner of a gas turbine is disclosed which includes a tubular body with an inlet for the entrance of a gas flow, at least one side vortex generator located downstream of the inlet and a lance projecting into the tubular body and having a terminal portion extending parallel to the longitudinal axis of the burner which is provided with at least one nozzle group for injecting fuel into the tubular body, the at least one nozzle group laying in an injection plane perpendicular to the axis of the terminal portion of the lance; an outlet downstream of the lance wherein a ratio x/L between an axial distance x between a trailing edge of the at least one side vortex generator and the injection plane, and the length L of the tubular body is less than 0.1052.

BRIEF DESCRIPTION OF THE DRAWINGS

Further features and advantages of the disclosure will be more apparent from the description of a preferred, non-exclusive embodiments of a burner of a gas turbine according to the disclosure, illustrated by way of non-limiting example in the accompanying drawings, in which.

DETAILED DESCRIPTION

An exemplary burner is disclosed which can improve mixing of fuel with gas flow coming from a high pressure turbine relative to known burners.

In addition, NOx emissions of an exemplary gas turbine as disclosed herein can be sensibly reduced when compared to the NOx emissions of known gas turbines.

An exemplary burner according to the disclosure also allows the CO emissions to be reduced.

Figure 1:
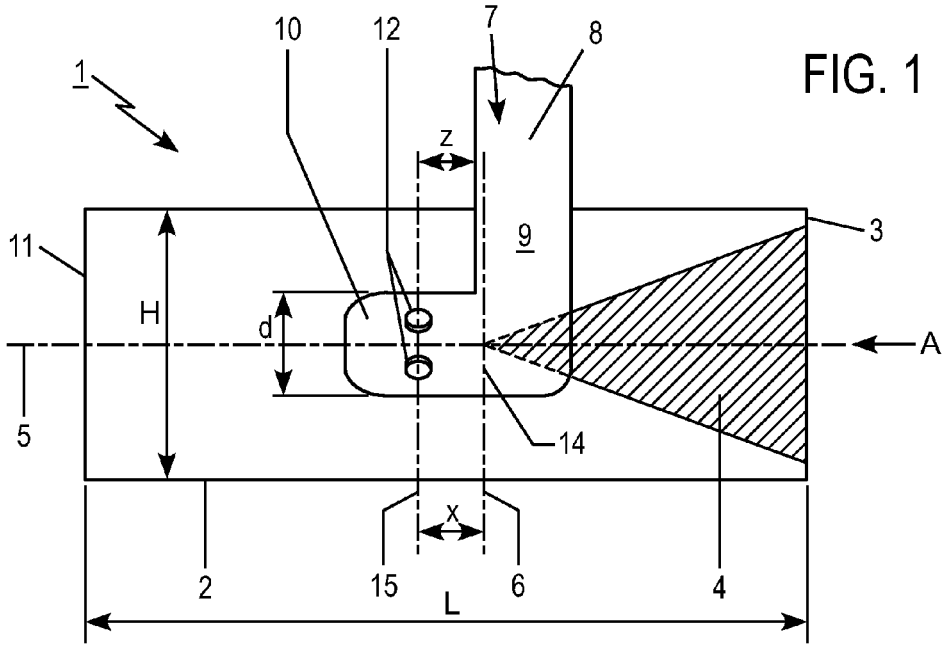
FIG. 1 is a schematic view of an exemplary burner according to the disclosure, wherein for sake of clarity only a side vortex generator behind a lance (which is partially hidden by the lance) is shown.
Figure 2:
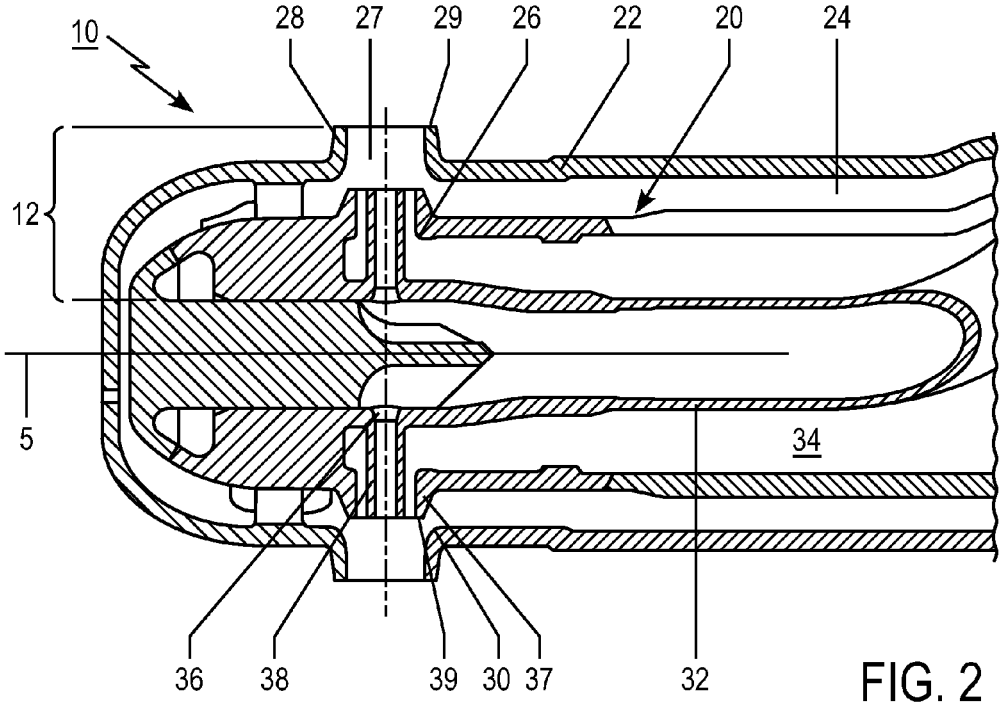
FIG. 2 is an enlarged section through a terminal portion of the lance.
Figure 3:
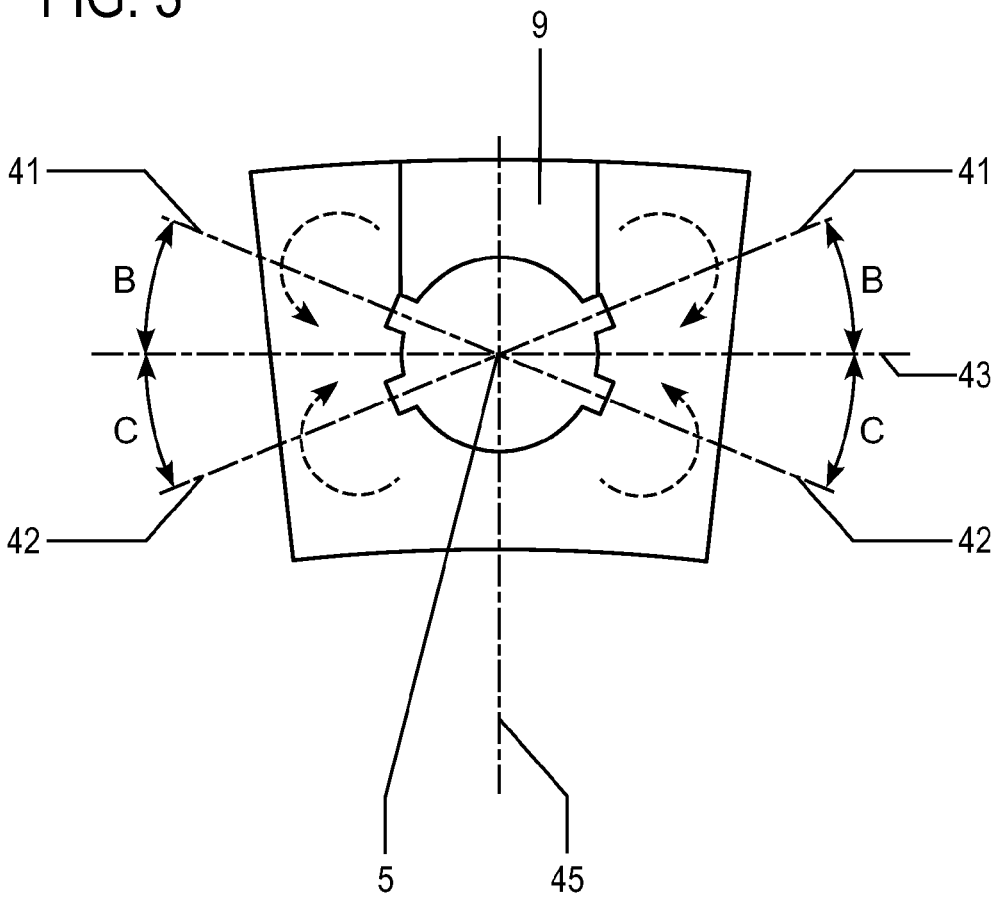
FIG. 3 is a schematic front view of the exemplary burner and, in particular, of the terminal portion of the lance.

With reference to FIG. 1, an exemplary burner 1 of a gas turbine is illustrated.

The burner 1 is a part of a sequential combustion machine wherein a first portion of fuel is injected (in a first burner) in a main air flow to form a mixture. The mixture is combusted and is expanded in a high pressure turbine. Afterwards further fuel is injected (in a second burner) in the already expanded flow to form a mixture. This mixture is combusted and expanded in a low pressure turbine.

The exemplary burner 1 of the present disclosure can be the second burner of the sequential combustion machine and can have a tubular body 2 (which has a trapezoidal cross section with a high H) with an inlet 3 for the entrance of the gas flow A.

Downstream of the inlet 3, the exemplary burner 1 has four vortex generators 4 of known type which extend along the longitudinal axis 5 of the burner 1.

Upper and bottom vortex generators can protrude from the upper and bottom walls of the trapezoidal body.

Two side vortex generators can project from the two side walls of the vortex generators and have trailing edges 14 which lay in the same plane 6 perpendicular to the axis 5 of the burner 1.

The burner 1 can further include a lance 7 projecting into the body 2.

The lance 7 can have a fuel supply portion 8 which is outside the tubular body 2, an intermediate portion 9 which is inside the tubular body 2 and extends perpendicularly to the axis 5 of the burner 1, and a terminal portion 10 which is housed inside the tubular body 2 and extends from the intermediate part 9 of the lance.

The terminal portion 10 can extend in a direction opposite the inlet 3 and parallel to the longitudinal axis 5 of the burner 1.

The terminal portion 10 can be provided with one or more nozzle groups 12 (the embodiment of the figures has four nozzle groups) for injecting a fuel into the tubular body 2.

In an exemplary embodiment, all of the nozzle groups 12 lay in an injection plane 15 which is perpendicular to the axis of the terminal portion 10 of the lance 7 (in the embodiment of FIG. 1, the axis of the terminal portion 10 of the lance 7 overlaps the axis 5, nevertheless in different embodiments the axis of the terminal portion of the lance does not overlap the axis 5 and can, for example, be parallel to it).

Downstream of the lance 7, the burner 1 includes an outlet 11 for supplying the mixture of gas (containing air) and fuel formed in the body 2 to the combustion chamber.

The ratio x/L between the axial distance x between the side trailing edges of the vortex generators 4 and the injection plane 15 (in other words the distance between the planes 6 and 15), and the length L of the tubular body of the burner 1 can, for example, be less than approximately 0.1052, preferably between −0.0276 and 0.1052 and more preferably between 0.000 and 0.1052.

Using different parameters and referring to the ratio z/d (where z is the axial distance from the lance stem trailing edge to the injection plane and d is the diameter of the terminal portion of the lance), the ratio z/d can, for example, be between 0.17 and 1.35 and preferably between 0.420 and 0.854.

The exemplary configuration of the burner 1 allows the fuel to be injected in a zone where vortices with a very high swirl number exist.

This configuration also allows a long mixing length to be obtained, without causing the fuel to be withheld in the burner for a too long time, in order to avoid flashback problems.

The lance 7 can include a first tubular element 20 arranged to carry a fuel and an outer tubular element 22 defining with the first tubular element 20 an annular conduit 24 arranged to carry air.

The first tubular element 20 can be provided with first nozzles 26 of the nozzle groups 12 and also the outer tubular element 22 can be provided with outer nozzles 27 of the nozzle groups 12.

As shown in the Figures, each outer nozzle 27 can be provided with a sleeve 28 protruding outwards.

The inner surface of each sleeve 28 of the outer nozzles 27 can, for example, be conical in shape and have a length from the external surface of the outer tubular element 22 to the free edge 29 which is, for example, equal or less than approximately 10 millimeters and preferably between 1-10 millimeters.

Figure 4:
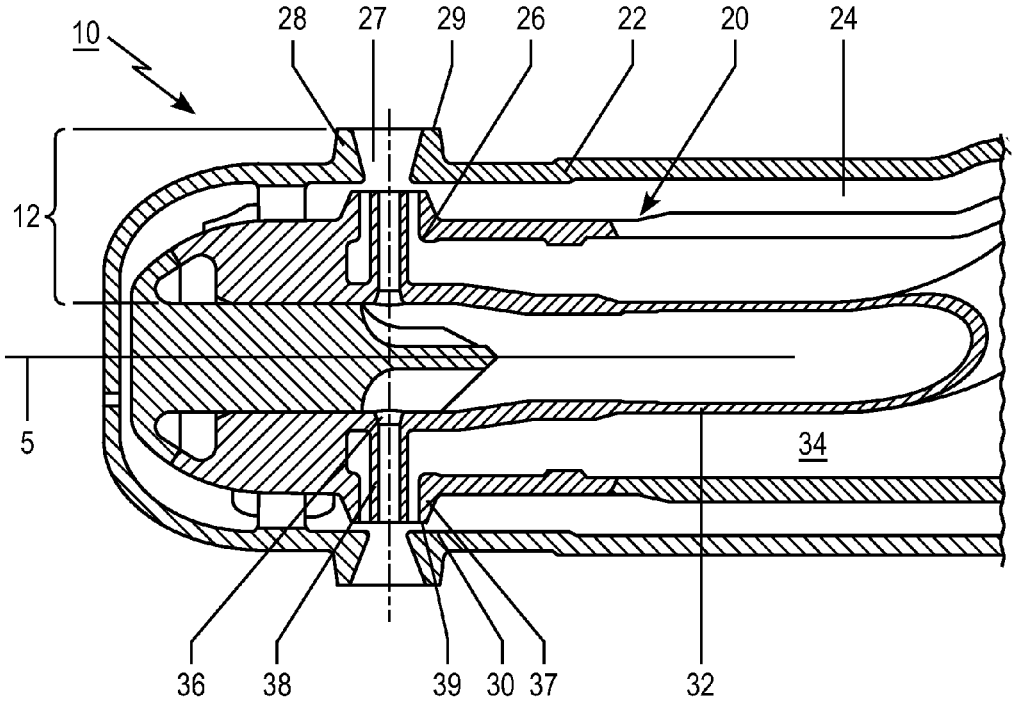
FIG. 4 is an enlarged section through a terminal portion of the lance.

The ratio between the outlet inner diameter and the inlet inner diameter of the sleeves 28 can, for example, be greater than 50% (FIG. 4), preferably between 78 and 98% and more preferably between 85 and 91% in an exemplary embodiment.

The conical sleeves contract the flow and can keep it perpendicular to the main flow.

This value of the length of the sleeves 28 let the penetration distance of the air/fuel injected be increased.

The inlet edge 30 of each sleeve 28 of the outer nozzles 27 can be rounded at the outer tubular element 22.

The first tubular element 20 can enclose a second tubular element 32 and define with it an annular conduit 34; this second tubular element 32 can have a closed end with second nozzles 36 of the nozzle groups 12.

Such a structure can allow the lance to eject a liquid fuel (through the tubular element 32) and/or a gaseous fuel (through the conduit 34) and also air (through the conduit 24).

The second nozzles 36 can be coaxial with the first nozzles 26, the outer nozzles 27 and the sleeves 28.

In a exemplary embodiment, the first nozzles 26 and the second nozzles 36 of each group of nozzles 12 can be provided with a cylindrical outwardly protruding portion 37, 38 having aligned free edges 39.

The cylindrical portion 37 can guide the gaseous fuel toward the exit and the cylindrical portion 38 can guide the liquid fuel toward the exit.

In addition, the cylindrical portion 37 also can have the function of guiding the carrier air toward the exit (the carrier air flows outside the cylindrical portion 37); in this respect the outer wall of the cylindrical portion 37 is, for example, conical in shape.

Specifically, the cylindrical portions 37, 38 of the first and second nozzles 26, 36 can be housed within the outer tubular element 22 and they can also be outside the corresponding sleeves 28 of the outer tubular element 22 (in other words the free edges 39 are outside the sleeves 28 and inside the outer tubular element 22).

The terminal portion 10 of the lance 7 can have four nozzle groups 12 which are placed in the injection plane 15.

The four nozzle groups can have their axes 41, 42 which are differently angled with respect to a transversal plane 43.

In particular, the angles B of the nozzle groups 12 towards the intermediate portion 9 of the lance 7 can be smaller than the corresponding angles C of the nozzle groups 12 opposite the intermediate portion 9 of the lance 7.

In an exemplary embodiment, the angles B of the nozzle groups 12 towards the intermediate portion 9 of the lance 7 are, for example, smaller than approximately (e.g., ±10%) 25° and greater than approximately 15° and they are preferably about 20°.

Moreover, the nozzle groups 12 can be symmetrically placed with respect to a longitudinal plane 45 which is perpendicular to the transversal plane 43.

An exemplary operation of the burner of a gas turbine of the disclosure is apparent from that described and illustrated and is substantially as follows:

The gas flow coming from the high pressure turbine (which contains air) enters the burner from the inlet 3 and passes through the vortex generators; in this zone the turbulence of the gas flow increases and the vortices can acquire a great swirl number.

Afterwards the gas flow passes at the terminal portion of the lance 7 where the fuel is injected.

The fuel is injected along the injection plane 15, (i.e., in a region of the burner which can have a very precise distance from the side vortex generators trailing edges, this distance being defined by the ratio x/L); the ratio x/L allows the injection of fuel in a zone where the turbulence and the swirl number of the vortices are so high that optimization of the mixing of the fuel with the gas flow can be obtained.

In addition, the very particular angles B, C allow injection of the fuel also in a transversal zone where the turbulence and the swirl number of the vortices are very high and the presence of the sleeves at the outer nozzles allow penetration of the fuel jet into the gas flow.

Experimental tests have been carried out with the burner of the disclosure.

The fuel mixing performances have been measured in a water channel facility with a LIF system and the combustion performances including emissions have been assessed in a combustion rig at high pressure.

Both tests have shown very high mixing quality, which resulted in strong reduction of NOx emissions; in addition also CO emissions were reduced.

In practice the materials used and the dimensions can be chosen at will according to the desired application and the preferences in the art.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

REFERENCE NUMBERS

1 gas turbine
2 tubular body
3 inlet
4 vortex generators
5 longitudinal axis of the burner
6 plane perpendicular to axis of the burner
7 lance
8 fuel supply portion of the lance
9 intermediate portion of the lance
10 terminal portion of the lance
11 outlet of the burner
12 nozzle groups
15 injection plane
20 first tubular element of the lance
22 outer tubular element of the lance
24 conduit
26 first nozzles
27 outer nozzles
28 sleeve
29 free edge
30 inlet edge
32 second tubular element
34 annular conduit
36 second nozzles
37, 38 outwardly protruding portions
39 aligned free edges
41, 42 axes of the nozzles
43 transversal plane
45 longitudinal plane
B angle towards the intermediate portion of the lance
C angle opposite the intermediate portion of the lance
x axial distance between the side trailing edges of the vortex generators and the injection plane
L length of the tubular body
z axial distance from the lance stem trailing edge to the injection plane
d diameter of the terminal portion of the lance

What is claimed is:

1. Burner of a gas turbine, comprising:

a tubular body with an inlet for entrance of a gas flow;

at least one side vortex generator located downstream of the inlet;

a lance projecting into the tubular body and having a terminal portion extending parallel to a longitudinal axis of the burner which is provided with at least one nozzle group for injecting fuel into the tubular body, the at least one nozzle group laying in an injection plane perpendicular to an axis of a terminal portion of the lance downstream of the lance;

an outlet downstream of said lance configured to supply a mixture of gas and fuel formed in the tubular body to a combustion chamber, wherein a ratio x/L between an axial distance x between a trailing edge of the at least one side vortex generator and the injection plane, and a length L of the tubular body is less than approximately 0.1052; and wherein a trailing edge of an intermediate portion of the lance, which is inside the tubular body and extends perpendicularly to the longitudinal axis of the burner, is downstream of tips of all the at least one side vortex generators, wherein each of the tips is a downstream edge of a corresponding side vortex generator of the at least one side vortex generators.

2. Burner as claimed in claim 1, wherein said ratio x/L is between −0.0276 and 0.1052.

3. Burner as claimed in claim 1, comprising:

two side vortex generators having trailing edges which lay in a plane perpendicular to the longitudinal axis of the burner.

4. Burner as claimed in claim 1, wherein said lance comprises:

at least a first tubular element arranged to carry a fuel; and an outer tubular element defining with said first tubular element an annular conduit arranged to carry air, said first tubular element being provided with a first nozzle of said nozzle group and said outer tubular element being provided with an outer nozzle of said nozzle group, wherein each outer nozzle is provided with a sleeve protruding outwards.

5. Burner according to claim 4, wherein a length of each sleeve of the outer nozzles from an external surface of the outer tubular element to a free edge of the tubular element is equal or less than 10 millimeters.

6. Burner according to claim 4, wherein a length of each sleeve of the outer nozzles from an external surface of the outer tubular element to a free edge of the tubular element is within a range of than 1-10 millimeters.

7. Burner according to claim 4, wherein an inner surface of the sleeve of each outer nozzle is conical in shape.

8. Burner according to claim 7, wherein a ratio between an outlet inner diameter and an inlet inner diameter of the sleeve is between 85-91%.

9. Burner according to claim 7, wherein a ratio between an outlet inner diameter and an inlet inner diameter of the sleeve is greater than 50%.

10. Burner according to any of claim 4, wherein an inlet edge of the sleeve of each outer nozzle is rounded at the outer tubular element.

11. Burner according to claim 4, wherein the first tubular element encloses a second tubular element to define an annular conduit, said second tubular element having a closed end with a second nozzle of each nozzle group being coaxial with said first nozzle and said outer nozzle and said sleeve of each outer nozzle.

12. Burner according to claim 11, wherein said first nozzle and said second nozzle of each group of nozzles are provided with cylindrical outwardly protruding portions having aligned free edges.

13. Burner according to claim 12, wherein an outer wall of a cylindrical portion of each first nozzle is conical in shape.

14. Burner according to claim 1, configured as a second burner of a sequential combustion machine.

15. Burner as claimed in claim 1, wherein said ratio x/L is between 0.000 and 0.1052.

16. Burner as claimed in claim 1, wherein the burner has a ratio z/d, where z is an axial distance from the lance stem trailing edge to the injection plane and d is a diameter of the terminal portion of the lance, and wherein the ratio z/d is between 0.17 and 1.35.

17. Burner as claimed in claim 16, wherein the ratio z/d is between 0.420 and 0.854.

18. Burner of a gas turbine, comprising:

a tubular body with an inlet for entrance of a gas flow;

at least one side vortex generator located downstream of the inlet;

a lance projecting into the tubular body and having a terminal portion extending parallel to a longitudinal axis of the burner which is provided with at least one nozzle group for injecting fuel into the tubular body, the at least one nozzle group laying in an injection plane perpendicular to an axis of a terminal portion of the lance downstream of the lance;

an outlet downstream of said lance, wherein a ratio x/L between an axial distance x between a trailing edge of the at least one side vortex generator and the injection plane, and a length L of the tubular body is less than approximately 0.1052; and wherein the cylindrical outwardly protruding portions of the first and second nozzles of each group are housed within said outer tubular element and outside the corresponding sleeve of the outer tubular element of the group.

19. Burner as claimed in claim 18, wherein said lance comprises:

at least a first tubular element arranged to carry a fuel; and an outer tubular element defining with said first tubular element an annular conduit arranged to carry air, said first tubular element being provided with a first nozzle of said nozzle group and said outer tubular element being provided with an outer nozzle of said nozzle group, wherein each outer nozzle is provided with a sleeve protruding outwards, wherein an inner surface of the sleeve of each outer nozzle is conical in shape.

20. Burner according to claim 19, wherein a ratio between an outlet inner diameter and an inlet inner diameter of the sleeve is greater than 50%.

21. Burner according to claim 18, wherein said lance comprises:

at least a first tubular element arranged to carry a fuel, wherein the first tubular element encloses a second tubular element to define an annular conduit, said second tubular element having a closed end with a second nozzle of each nozzle group being coaxial with said first nozzle and said outer nozzle and said sleeve of each outer nozzle, wherein said first nozzle and said second nozzle of each group of nozzles are provided with cylindrical outwardly protruding portions having aligned free edges; and an outer tubular element defining with said first tubular element an annular conduit arranged to carry air, said first tubular element being provided with a first nozzle of said nozzle group and said outer tubular element being provided with an outer nozzle of said nozzle group, wherein each outer nozzle is provided with a sleeve protruding outwards.

22. Burner according to claim 18, wherein the terminal portion of the lance extends from an intermediate portion which is inside said tubular body and connects the terminal portion to a fuel supply portion of the lance which is outside the tubular body, wherein the terminal portion has four nozzle groups which are placed in said injection plane, said four nozzle groups having two nozzle and have axes differently angled with respect to a circumferential transversal plane, and the nozzle groups are symmetrically placed with respect to a longitudinal plane which is perpendicular to the circumferential transversal plane; and wherein an angle of a first axis towards the intermediate portion of the lance is smaller than an angle of a second axis opposite the intermediate portion of the lance.

23. Burner of a gas turbine, comprising:

a tubular body with an inlet for entrance of a gas flow;

at least one side vortex generator located downstream of the inlet;

a lance projecting into the tubular body and having a terminal portion extending parallel to a longitudinal axis of the burner which is provided with at least one nozzle group for injecting fuel into the tubular body, the at least one nozzle group laying in an injection plane perpendicular to an axis of a terminal portion of the lance downstream of the lance;

an outlet downstream of said lance configured to supply a mixture of gas and fuel formed in the tubular body to a combustion chamber, wherein a ratio x/L between an axial distance x between a trailing edge of the at least one side vortex generator and the injection plane, and a length L of the tubular body is less than approximately 0.1052;

wherein the terminal portion of the lance extends from an intermediate portion which is inside said tubular body and connects the terminal portion to a fuel supply portion of the lance which is outside the tubular body, wherein the terminal portion has four nozzle groups which are placed in said injection plane, said four nozzle groups having two nozzle axes differently angled with respect to a circumferential transversal plane, and the nozzle groups are symmetrically placed with respect to a longitudinal plane which is perpendicular to the circumferential transversal plane; and wherein the intermediate portion extends inside the tubular body perpendicularly to the axis of the burner and extends from the terminal portion to the tubular body, and wherein an angle of a first axis of the two nozzle axes towards a direction of an extension of the intermediate portion from the longitudinal axis of the burner of the lance is smaller than an angle of a second axis of the two nozzle axes opposite the direction of the extension of the immediate portion from the longitudinal axis of the burner.

24. Burner according to claim 23, wherein the angles between the axes of the nozzle groups towards the intermediate portion of the lance are smaller than 25° and greater than 15°.

* * * * *